United States Patent [19]

Ahrenskou-Sorensen

[11] 4,134,689

[45] Jan. 16, 1979

[54] MIXING APPARATUS

[75] Inventor: Börge Ahrenskou-Sörensen, Hägersten, Sweden

[73] Assignee: Svenska Skandex AB, Stockholm, Sweden

[21] Appl. No.: 794,144

[22] Filed: May 5, 1977

[51] Int. Cl.[2] ..... B01F 11/00

[52] U.S. Cl. ..... 366/110; 366/111; 366/128; 366/211; 366/605; 108/147

[58] Field of Search ..... 259/48, 59, 54–56, 259/72, 73, 75, 91; 366/108, 110, 111, 211, 116, 208, 128, 210, 605, 216; 248/154, 157, 507–509; 108/147, 106

[56] References Cited

U.S. PATENT DOCUMENTS

| | | | |
|---|---|---|---|
| 2,022,527 | 11/1935 | Schletz | 259/6 |
| 3,706,443 | 12/1972 | Oberhauser | 259/72 |
| 3,943,844 | 3/1976 | Standbridge | 108/147 |
| 4,004,784 | 1/1977 | Distler | 259/72 |

*Primary Examiner*—Billy J. Wilhite
*Assistant Examiner*—Timothy F. Simone
*Attorney, Agent, or Firm*—Burns, Doane, Swecker & Mathis

[57] ABSTRACT

There is provided a mixing apparatus wherein liquid or pulverous material is mixed by shaking a can containing the material to be mixed. An inner frame of the apparatus is provided with a table for the can and a means for clamping the can to the table. The inner frame is arranged for vibration relative to an outer frame. An electric motor is mounted on the outer frame and drives by way of a transmission system the clamping means, which comprises a screw/nut assembly. Two parallel links couple the inner frame to the outer frame and the motor power is transferred.

A pulley/belt assembly transfers the motor power to that part of the transmission system which is mounted on the inner frame. The pulleys of this assembly are substantially coaxial with the pivot axes of the links.

A remote control system is provided for automatic sequential and controlled operation of the apparatus functions during a mixing cycle, i.e. clamping shaking and releasing a can.

5 Claims, 4 Drawing Figures

MIXING APPARATUS

This invention relates to mixing apparatus and refers generally to such apparatus wherein pulverous or liquid material is mixed by shaking receptacles therefor.

More specifically the invention concerns improved receptacle clamping means in such mixing apparatus.

A mixing apparatus of the above indicated type is revealed in applicant's British Pat. No. 1,310,655, and the teachings of British patent 1,310,655 are hereby incorporated herein by reference.

Mixing by means of shaking is used, for example for a tinting paint, i.e. mixing a base paint with a tinting paint. Subsequent to pouring the tinting paint into the base paint, it is necessary to stir the mixture very thoroughly in order to obtain a paint of uniform colour. To this end it is normal to use an apparatus having a table provided with clamping means for a receptacle containing the material to be blended, the table being secured to an inner frame which is movable in relation to an outer frame, resting on the supporting surface, and is caused to move by means of a crank or eccentric shaft which in turn is driven by a motor arranged in the apparatus.

In the apparatus according to British Pat. No. 1,310,655 the receptacle is clamped to the table by means of a plate which by means of a rod can be adjusted to any desired distance from the table, the rod being lockable relative to the inner frame in the desired position by means of a known quick-locking device.

Such a clamping means, however, exhibits certain disadvantages. One of these is that the maximum height of the apparatus will be fairly large as the rod will project upwardly a considerable distance not only when the clamping plate is in its top position but also in operative positions. Moreover, the rod will vibrate during operation, and constitutes a risk, for the operator. Another disadvantage is that the shaking can be started even if the clamping means has not been properly tightened. A further disadvantage is that the clamping force cannot easily be controlled, which in turn means that the receptacle easily could be crushed or that the receptacle is insufficiently clamped in the apparatus. Another disadvantage of the known apparatus is that the known clamping means cannot readily be modified for remote control.

One object of the present invention is to provide a novel clamping means in a mixing apparatus whereby one or more of the above mentioned disadvantages are eliminated.

Another object of the invention is to provide a novel clamping means which is of such structural design as to permit remote control of transmission for driving the clamping mechanism via a motor that is mounted on an outer frame and therefore stationary relative to the vibrating inner, receptacle carrying frame.

Other objects and advantages of the invention will be appreciated by those skilled in the art as the specification proceeds.

The invention relates to an apparatus for mixing liquid or pulverous material by shaking, comprising a table, vibratory motion producing means connected to the table, and clamping means comprising a cross-member for clamping a receptacle to the table, which receptacle contains the material to be mixed, and the inventive improvement resides in that the clamping means further comprises at least two screws extending perpendicularly to and upwardly from the support surface of the table, the screws being located to straddle the receptacle and rotatably mounted relative to the table, and axially fixed relative to the table, a nut on each screw, the nuts being fixed on the cross-member, transmission means connecting the screws for synchronous rotational movement, an electric motor arranged to drive the transmission means, means sensing the power exerted by the motor in the clamping sense, and control means arranged to permit start of the vibratory motion producing means only when the sensing means has sensed a clamping power of a predetermined level. Hereby shaking can be started only when the sensed clamping power is sufficient, and moreover a proper clamping of the receptacle is obtained while still the receptacle is prevented from being crushed by the clamping means as the motor suitably is deenergized as the power reaches said level. Optionally the transmission drive motor can remain energized (but only fed in the extent necessary to maintain a clamping power slightly above said level) during the vibratory motion of the apparatus and thereby be able to tighten the clamping means during the shaking if need therefor should arise.

However, the transmission between the transmission drive motor and the nuts has normally such an exchange ratio that the transmission will act self-locking.

Preferably the inventive mixing apparatus comprises an outer frame for supporting the apparatus, an inner frame to which the table is secured and an intermediate frame, which is resiliently supported by the outer frame, said inner frame being movable relative to the intermediate frame, a crank shaft for moving the inner frame relative to the intermediate frame, drive means for the crank shaft, said crank shaft being journalled in the intermediate frame and the drive means being secured to the intermediate frame, the inner frame being connected at one end thereof to the intermediate frame by means of at least one link.

In the preferred embodiment of the mixing apparatus, the electric motor for driving the clamping means is fastened on the intermediate frame, and an angle gear is mounted on the inner frame. The motor shaft and the input shaft of the gear which are interconnected by way of a pulley/belt arrangement are arranged in parallel and preferably the output shaft of the gear is arranged coaxial with and fixed to one of the screws. The screws are each fitted with a tooth pulley and an endless tooth belt connects these pulleys such that the screws (having the same pitch) will perform a synchroneous rotational movement.

The link is at one end thereof pivotably connected to the intermediate frame at a pivot axis that is substantially coaxial with the motor shaft. The link is at the other end thereof pivotably connected to the inner frame at a pivot axis that is substantially coaxial with the input shaft of the angle gear. Hereby the link and the belt transmission between the motor and the angle gear will move in parallel during the shaking, and the shaking will not bring about any noticable forces in the belt transmission. In turn this means that as the motor can be mounted on the intermediate frame which does not vibrate in any substantial extent during the shaking operation the lifetime of the motor is enhanced and that the power supply of the electric motor is simplified and can be made safer.

In the following the invention is closer described with reference to the enclosed drawings of a schematic embodiment of the apparatus.

DESIGN

Figure 1:
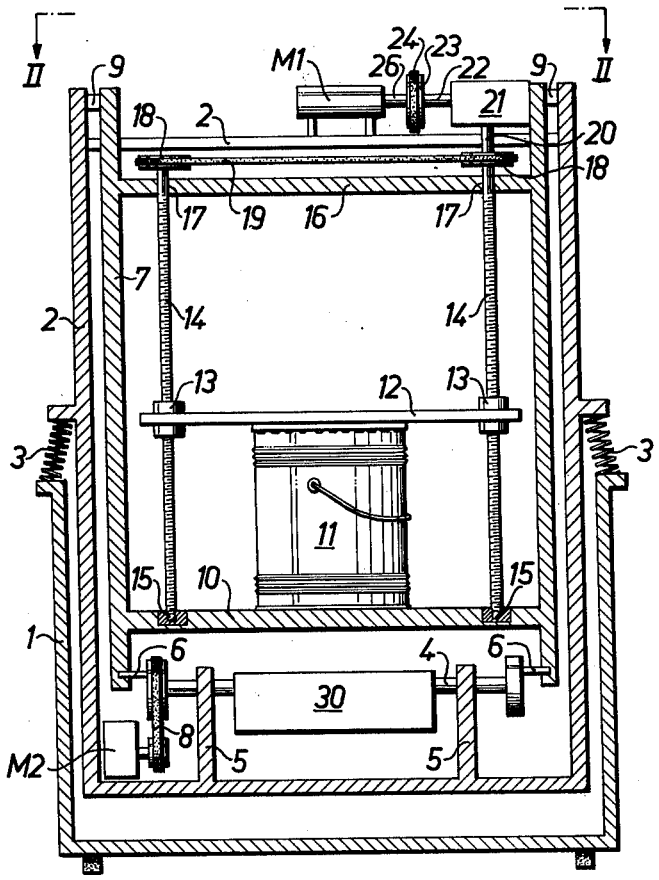
FIG. 1 shows an elevational view of the frame works of the apparatus.

In FIG. 1 there is shown an outer frame 1 which rests on the floor. An intermediate or second frame 2 is supported in the outer frame 1 by means of springs 3 or the like. In the lower part of the second frame, there is a motor M2. A crank 4 is supported by the second frame via bearing means 5. The crank 4 has two eccenter pins 6 which are connected to an inner frame 7. An eccentric weight 30 is fastened to the crank shaft 4. The weight 30 is displaced 180° relative to the pins 6, and is arranged to counterbalance a medium load on the inner frame (i.e. the inner frame plus a medium weight receptacle). The crank is driven by the motor M2 via a belt transmission 8.

Figure 2:
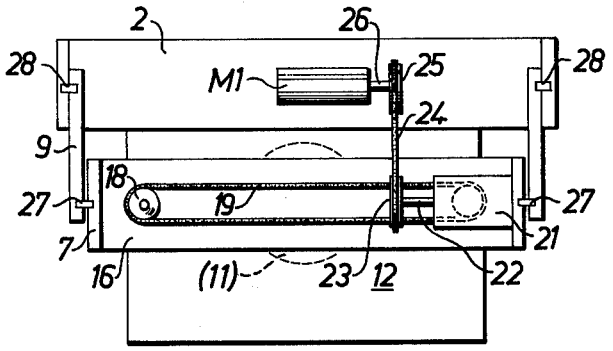
FIG. 2 shows a topview of the apparatus, as seen from II—II in FIG. 1.

As can be seen also in FIG. 2, the upper part of the inner frame 7 is connected to the second frame 2 by means of links 9. Thus, when the motor M2 is driven the inner frame will be subjected to a vibration, the path of which can be considered as pear shaped.

The inner frame 7 has a table 10 for one or more receptacles 11 to be shaked.

In order to keep the receptacle 11 clamped to the table, there is provided a clamping plate 12. Nuts 13 are fixed at the plate 12. Screws 14 mesh with the nuts 13. The lower ends of the screws 14 are mounted in the table at 15 and the mounting is such that the screws are rotatable but not axially movable. An upper cross-member 16 of the inner frame is provided with bearings 17 to guide the screws 14 for rotational movement. A pulley 18 is fastened on the upper end of each screw 14 above member 16, and an endless belt 19 connects the pulleys 18. One of the screws 17 (the right-hand one in FIG. 1) is connected to the substantially vertical output shaft 20 of an angle-gear 21, which is mounted relative to the inner frame 7. The input shaft 22 of the angle-gear 21 extends substantially horizontally and substantially in parallel with the crank shaft 4.

A pulley 23 is fastened on the input shaft 22 and an endless belt 24 connects pulley 23 to a pulley 25 on the output shaft 26 of an electric motor M1 which is mounted on the intermediate frame 2.

The links 9 coupling the inner frame 7 to the intermediate frame 2 are pivotable in the vertical plane and are arranged in parallel to each other. The pivot points 27 of the links 9 to the inner frame 7 lie along an axis which is substantially coaxial with the input shaft 22 of the angle-gear 21. The pivot points 28 of the links 9 to the intermediate frame 2 lie along an axis which is substantially coaxial with the pulley 25 of motor M1.

Hereby the pulley/belt transmission 23–25 between the motor M1 and the angle-gear 21 will not be disturbed when the inner frame 7 vibrates relative to the intermediate frame 2. Moreover, the motor M1 can be driven with standard voltage as the leads to the motor are not subjected to any substantial vibration.

Should the motor have been mounted on the inner frame 7 the motor as well as the motor current leads would be subjected to substantial vibration which in turn would reduce the work-life of the motor and necessitate a low voltage motor feed.

It is clearly seen, that the illustrated clamping means is very compact in the vertical sense in relation to the clamping gap available. Moreover, upper transmission of the clamping means is readily covered by a cap (not shown) which can be fastened on the outer frame 1.

OPERATION & CONTROL

Assume that the clamping plate 12 is located in an upper position.

A receptacle 11 is now placed on the table 10 under the clamping plate 12.

The motor M1 is started and runs in a direction to lower the plate 12.

When the plate 12 engages the receptacle 11 a clamping force is exerted on the receptacle. As the force reaches a predetermined value (say 400 pounds) the motor M1 is deenergized and motor M2 is started. Due to the exchange ratio of the nut and screw assembly 13, 14, the belt transmission 18, 19, the gear 21 and the belt transmission 23–25, the plate 12 is self-locking in this position and the motor M1 merely has to exert a relatively low torque in order to provide said clamping force.

The deenergization of motor M1 can be controlled by sensing the feed power to the electric motor M. The power is an indication on the torque exerted by the motor. Thus, when the power reaches a certain value corresponding to the desired clamping force, the receptacle tightening action is interrupted and the motor M2 is automatically started.

A timer may be arranged to control the running time of the motor M2.

It is appreciated that motor M1 after having reached the desired clamping torque, can be deenergized by the sensed torque limit value, and stay deenergized during the operation of motor M2, as the exchange ratio in the transmission between motor M1 and the plate 12 is high enough to be self-locking. On the other hand it is quite feasible to bring the motor M1 to exert the torque necessary to maintain the clamping force (preferably 400 pounds) during the entire shaking operation. Hereby the motor M1 can tighten the clamping plate, should the lid of the receptacle be improperly fitted, and suddenly snap into its proper position, for example As the timer runs out the motor M2 is deenergized, and the motor M1 is switched for reverse run and is then brought to run in order to lift the plate 12. After a predetermined period of time the motor M1 is deenergized and switched back for the normal running direction.

Alternatively, as the plate 12 abuts cross-member 16, the power of the motor M1 will reach said predetermined level, and this level may be utilized to deenergized the motor M1.

The apparatus has now returned to the assumed starting condition, and the same cycle can now be repeated for one or more fresh receptacles the contents of which is to be mixed.

The motor M1 is preferably a symmetric motor or the like, which exerts the same torque in both rotational directions. Suitably the motor is permitted a higher start-up torque than deenergizing torque.

Figure 3:
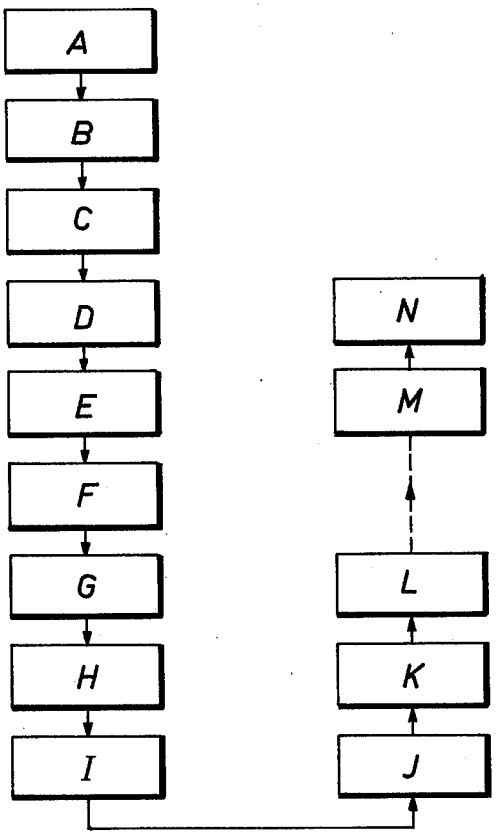
FIG. 3 shows a block diagramme over the operation of the apparatus and FIG. 4 shows a circuit diagramme for the apparatus.

The control and run sequence of the apparatus is illustrated in FIG. 3.

Assume that a receptacle has been placed on the table. By actuating a start switch A the sequence B-L will automatically be carried through.

A. START

B. M1 is switched for running in clamping sense
C. M1 is energized and starts to run
D. means sensing the torque exerted by M1
E. means controlled by the sensing means and arranged to deenergize M1 at a predetermined torque
F. M1 stops
G. M2 starts
H. adjustable timer for the M2 run
I. M2 stops
J. M1 is switched for reverse run
K. M1 is energized a predetermined time period
L. M1 stops The receptacle can now be removed and the apparatus is ready to repeat the operation cycle. However, should the next receptacle be taller, the operator can actuate a switch M whereby the clamping gap is widened, possibly until the clamping plate abuts a stop at the upper end of the inner frame, and then the sequence steps D and E may apply. Anyway M1 is either deenergized by the operator or by step E.

Thus, the apparatus is after step L or optionally after step N ready for a new work cycle. Step M may be considered to involve means for continued declamping run of M1, and step M is automatically followed by step N which merely states that M1 stops.

Figure 4:
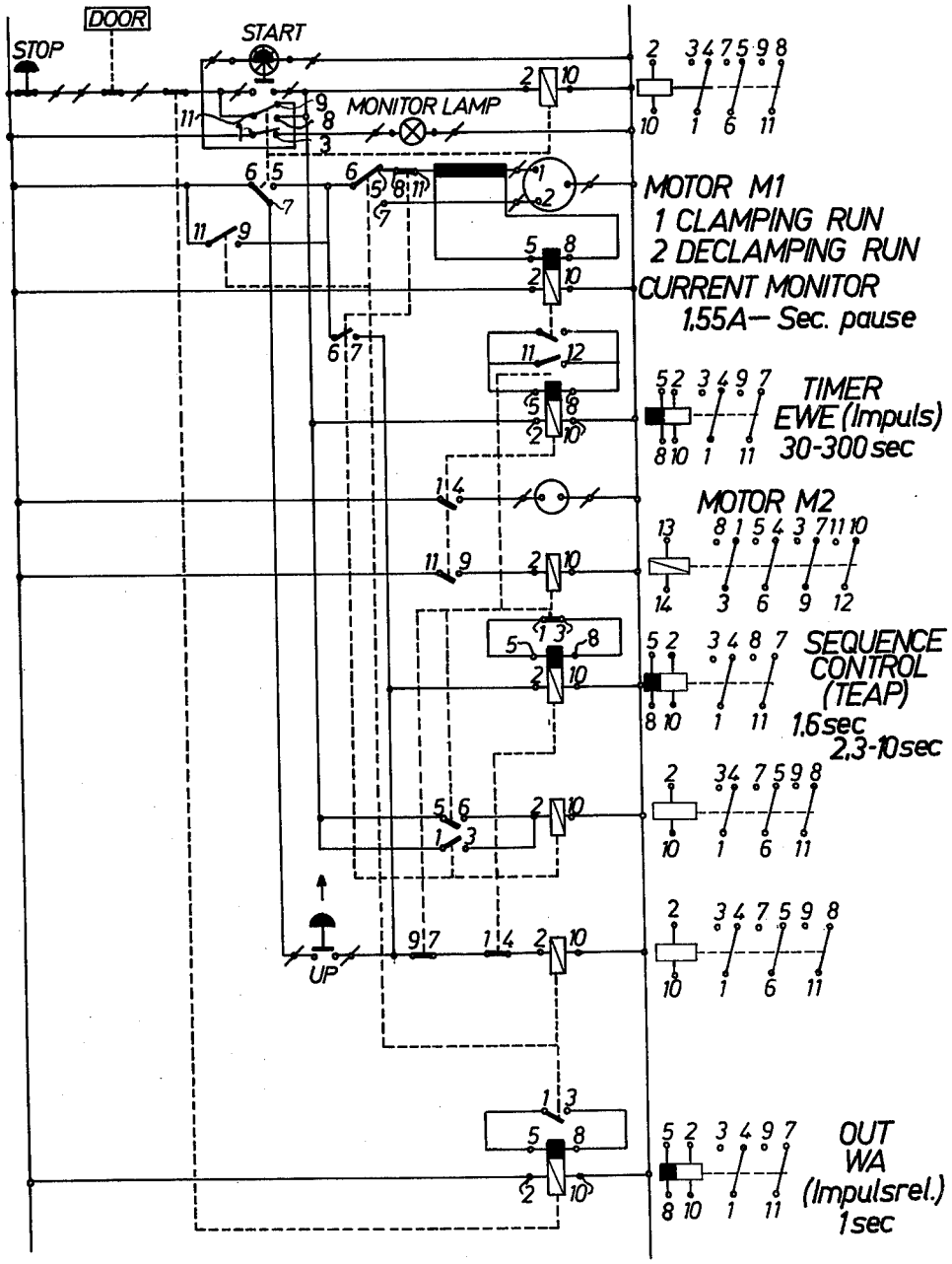

The specific means utilized to perform the above sequence are well-known to those skilled in the art and may be embodied as desired. One example on a wiring for performing the apparatus operation is illustrated in FIG. 4. It is believed that FIG. 4 is selfexplanatory to those skilled in the art.

The apparatus according to the invention has a door (preferably transparent) which leads into a compartment containing the table 10 and the clamping plate 12. The door controls a switch in the main power line, whereby the apparatus cannot be started unless the door is closed, and the apparatus is deenergized should the door be opened during operation of the apparatus.

What is claimed is:

1. In an apparatus for mixing liquid or pulverous material by shaking, including a table having a support surface, vibratory motion producing means connected to said table, and clamping means having a cross-member for clamping a receptacle to the table, said receptacle containing the materials to be mixed, the improvement comprising:

at least two screws extending perpendicularly to and upwardly from the support surface of said table, said screws being located to straddle the receptacle and being rotatably mounted relative to the table, and axially fixed relative to the table;

a nut on each screw;

said nuts being fixed on said cross-member;

transmission means connecting said screws for synchronous rotational movement;

an electric motor arranged to drive said transmission means;

and wherein said vibratory motion producing means includes:

an inner frame supporting said table; an intermediate frame disposed about said inner frame and adapted to support said electric motor;

linking means pivotably connecting the upper part of said intermediate frame to the upper part of said inner frame;

a first pulley driven by the motor; a second pulley connected to said transmission means;

an endless belt connecting said first and second pulleys;

said pulleys being mounted substantially coaxially with the pivot axes of said linking means.

2. An apparatus as claimed in claim 1 further including means for sensing the power exerted by the motor in the clamping sense, and control means arranged to permit start of said vibratory motion producing means only when the sensing means has sensed a clamping power of a pre-determined level.

3. An apparatus as claimed in claim 1 further including an outer frame disposed about said intermediate frame;

means for resiliently mounting said intermediate frame on said outer frame.

4. An apparatus for mixing liquid or pulverous material by shaking comprising:

an outer frame for supporting the apparatus; an intermediate frame resiliently supported within said outer frame;

an inner frame movably supported within said intermediate frame;

a crank shaft journaled in said intermediate frame and adapted for moving said inner frame relative to said intermediate frame;

drive means for said crank shaft secured to said intermediate frame;

at least one linking means for connecting one end of said inner frame to one end of said intermediate frame;

a table secured to said inner frame and having a supporting surface;

a clamping means including:

a cross-member for clamping to said table a receptacle containing material to be mixed; at least two screws extending perpendicularly to and upwardly from the support surface of said table, said screws being located to straddle said receptacle and rotatably mounted relative to said table, a nut on each screw, said nuts being fixed to said cross-member;

transmission means connecting said screws for synchronous rotational movements and including;

an electric motor mounted on said intermediate frame and arranged to drive said transmission means;

an angled gear mounted on said inner frame and having an input shaft and having an output shaft operatively connected to one of said screws for driving said screw; a tooth pulley fitted on each of said screws;

an endless tooth belt interconnecting said tooth pulleys; pulleys mounted respectively on the output shaft of said electric motor and the input shaft of said angle gear; endless belt means connecting said motor shaft pulley and angle gear input shaft pulley and arranged in parallel, said link being at one end thereof pivotably connected to said intermediate frame at a pivot axis which is substantially coaxialy with the said electric motor shaft, said link being at the other end thereof pivotably connected to said inner frame at a pivot axis that is substantially coaxial with said input shaft of said angled gear.

5. An apparatus as claimed in claim 4 comprising means sensing the power exerted by the motor in the clamping sense, and control means arranged to permit start of the vibratory motion producing means only when the sensing means has sensed a clamping power of a predetermined level.

* * * * *